United States Patent [19]

Kondo et al.

[11] Patent Number: 4,611,569

[45] Date of Patent: Sep. 16, 1986

[54] IGNITION SYSTEM

[75] Inventors: Tadashige Kondo; Susumu Ohno, both of Tokyo, Japan

[73] Assignee: Kioritz Corporation, Tokyo, Japan

[21] Appl. No.: 739,309

[22] Filed: May 30, 1985

[30] Foreign Application Priority Data

Jun. 11, 1984 [JP] Japan ..... 59-85589[U]

[51] Int. Cl.[4] ..... F02P 3/08

[52] U.S. Cl. ..... 123/600; 123/149 C; 123/424; 123/602

[58] Field of Search ..... 123/149 C, 424, 599, 123/600, 602

[56] References Cited

U.S. PATENT DOCUMENTS 3,651,795 3/1972 Noddin ..... 123/149 C X
3,721,223 3/1973 Randau et al. ..... 123/424 X
4,108,131 8/1978 Shibukawa ..... 123/600
4,337,748 7/1982 Engman ..... 123/602

FOREIGN PATENT DOCUMENTS 77562 6/1981 Japan ..... 123/602

*Primary Examiner*—Tony M. Argenbright
*Attorney, Agent, or Firm*—Browdy & Neimark

[57] ABSTRACT

An ignition system of an internal combustion engine including a bypass circuit having a switch capable of being closed to cause a current produced by a counter electromotive force generated by a first generating coil to bypass a thyristor, and a second generating coil located anterior to the first generating coil with respect to the direction of rotation of a rotary member supporting a permanent magnet, to generate an electromotive force under the influences of the permanent magnet to cause the thyristor to turn on.

1 Claim, 3 Drawing Figures

IGNITION SYSTEM

BACKGROUND OF THE INVENTION

This invention relates to ignition systems of internal combustion engines, and more particularly, it is concerned with an ignition system of an internal combustion engine suitable for use with a chain saw, a mowing apparatus, an engine-driven sprayer, etc., of a portable type.

In one ignition system of the prior art suitable for use with the aforesaid type of engine, a permanent magnet having a positive pole and a negative pole is mounted to a rotary member, such as a flywheel, of the associated internal combustion engine and acts on a generating coil while the flywheel rotates to cause same to generate an electromotive force to produce an electric current which flows from the generating coil to an ignition capacitor to charge same. Then, the magnet causes the generating coil to generate a counter electromotive force to cause a thyristor of an ignition circuit to turn on, thereby causing the ignition capacitor to begin to discharge to produce a high voltage in an ignition coil, thereby causing a spark discharge to take place in an ignition plug of the internal combustion engine.

The ignition system of the aforesaid construction of the prior art is unable to cause a spark discharge to occur in the ignition plug at a timing optimum for the range of low engine speeds and the range of high engine speeds. The chain saw, mowing apparatus and engine-driven sprayer of the portable type generally operate in a condition in which the throttle is fully open or fully closed, and it is rare that they operate in a condition in which the throttle remains partly open. Thus, the problem raised with this type of ignition system is that it reduces the efficiency of the internal combustion engine.

SUMMARY OF THE INVENTION

This invention has been developed for the purpose of obviating the aforesaid disadvantage of the prior art.

One object of the invention is to provide an ignition system of an internal combustion engine which is capable of delaying ignition timing when the engine speed is low, such as at engine startup or during engine idling, and of advancing ignition timing when the engine speed is high, by an instantaneously actuating, either automatically or manually by the operator, switch which is associated with a throttle valve, for example, to thereby keep the performance of the engine at a high level.

Another object is to provide an ignition system of an internal combustion engine that can be applied to internal combustion engines of different types without altering the construction of its circuit.

A still another object is to provide an ignition system of an internal combustion engine which is simple in construction and yet suitable for use with the internal combustion engine of the chain saw, mowing apparatus and the engine-driven sprayer of the portable type which is often required to rapidly accelerate during operation.

According to the invention, there is provided an ignition system of an internal combustion engine comprising a permanent magnet supported by a rotary member of the engine adapted to rotate in synchronism with a rotary shaft of the engine, a generating coil for generating an electromotive force to produce an electric current as the permanent magnet acts on the generating coil during the rotation of the rotary member, an ignition capacitor charged by the electric current generated by the generating coil, a thyristor caused to turn on by a counter electromotive force generated by the generating coil to thereby cause the ignition capacitor to begin to discharge, and an ignition coil generating a high voltage as the ignition capacitor beings to discharge, to cause a spark discharge to take place in an ignition plug of the internal combustion engine, wherein the improvement comprises a bypass circuit having a switch capable of being closed to cause an electric current produced by the counter electromotive force to bypass the thyristor, and a second generating coil located anterior to the first-mentioned generating coil with respect to the direction of rotation of the rotary member for generating an electromotive force under the influences of the permanent magnet to cause the thyristor to turn on.

DESCRIPTION OF THE PREFERRED EMBODIMENTS

Figure 1:
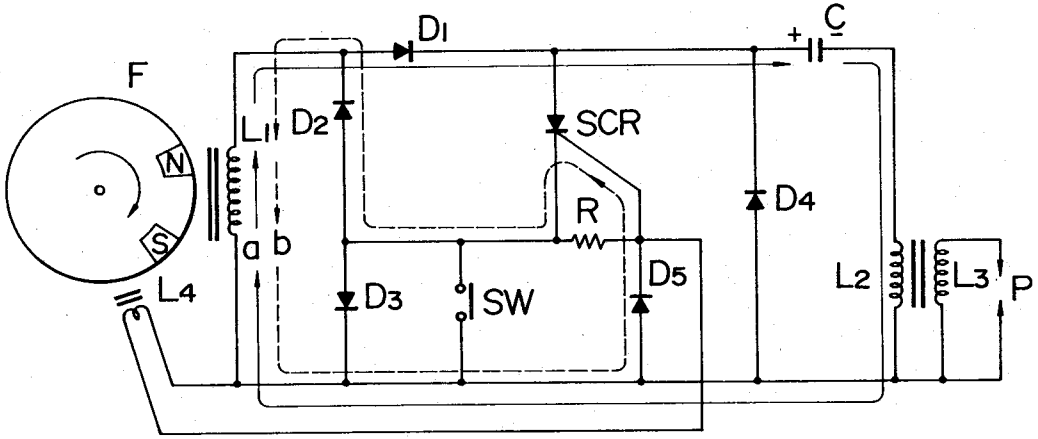
FIG. 1 is a circuit diagram of the ignition system of an internal combustion engine comprising one embodiment of the invention.

FIG. 1 shows one example of the electrical circuit of the ignition system comprising one embodiment of the invention. A permanent magnet having a negative pole S and a positive pole N located in predetermined angular positions relative to each other at an outer periphery of a flywheel F supported on an output shaft of an internal combustion engine, not shown, and rotating in synchronism therewith. A first generating coil $L_1$ is located in a position in which it is operatively associated with the permanent magnet to periodically generate an electromotive force while the flywheel F rotates to charge an ignition capacitor C. $L_2$ and $L_3$ designate a primary winding and a secondary winding, respectively, of an ignition coil, and $L_4$ is a second generating coil located in a position anterior to the position in which the first generating coil $L_1$ is located with a predetermined angular relation with respect to the direction in which the flywheel F rotates, to periodically generate an electromotive force with a time lag behind the electromotive force generated by the first generating coil $L_1$ as the permanent magnet passes by the second generating coil $L_4$ . $D_1$, $D_2$, $D_3$, $D_4$ and $D_5$ are diodes, and P is an ignition plug of the internal combustion engine connected to the secondary winding $L_3$ of the ignition coil. R, SCR and SW designate a resistor, a thyristor and an on-off switch, respectively. These elements are arranged in positions and connected together as shown in the circuit diagram in FIG. 1.

Figure 2:
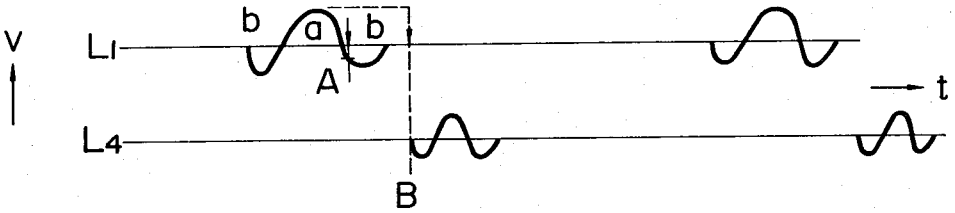
FIG. 2 shows the wave form of voltages produced in the circuit shown in FIG. 1.

As the two poles S and N of the permanent magnet pass by the first generating coil $L_1$ during the rotation of the flywheel F while the switch SW is kept in an open position (OFF), an electromotive force oriented in the direction of an arrow a in FIG. 1 is generated by the first generating coil $L_1$ and causes a current to pass from the first generating coil $L_1$ through the diode $D_1$, the capacitor C, the primary winding $L_2$ of the ignition coil and back to the first generating coil $L_1$, to charge the capacitor C. Then, another electromotive force oriented in the direction of an arrow b in FIG. 1 is generated by the first generating coil $L_1$ and causes a current to flow from the first generating coil $L_1$ through the diode $D_5$ to a gate of the thyristor SCR from which the current flows through a cathode of the thyristor SCR and the diode $D_2$ before returning to the first generating coil $L_1$, to cause the thyristor SCR to turn on. This causes electricity stored in the capacitor C to pass from the capacitor C through the thyristor SCR, diode $D_3$, the primary winding $L_2$ of the ignition coil and back to the capacitor C, to generate a high voltage in the secondary winding $L_3$ of the ignition coil. This causes a spark discharge to take place in the ignition plug P. The timing at which the spark discharge takes place is indicated by a point A in FIG. 2.

The first generating coil $L_1$ also produces an electromotive force oriented in the direction of the arrow a during the rotation of the flywheel F while the switch SW is kept in a closed position (ON), to charge the capacitor C as described hereinabove. Then, an electromotive force oriented in the direction of the arrow b is generated by the generating coil $L_1$. A current produced by this electromotive force flows through the switch SW, so that it does not cause the thyristor SCR to turn on, thereby preventing electricity from being released from the capacitor C at this time. As the magnet passes by the second generating coil $L_4$ following further rotation of the flywheel F, the second generating coil $L_4$ generates an electromotive force and causes a current to pass from the second generating coil $L_4$ through a gate and a cathode of the thyristor SCR and the diode $D_4$ before returning to the second generating coil $L_4$, to cause the thyristor SCR to turn on. This causes the capacitor C to begin to discharge, so that a spark discharge takes place in the ignition plug P at a timing which is indicated by B in FIG. 2.

Figure 3:
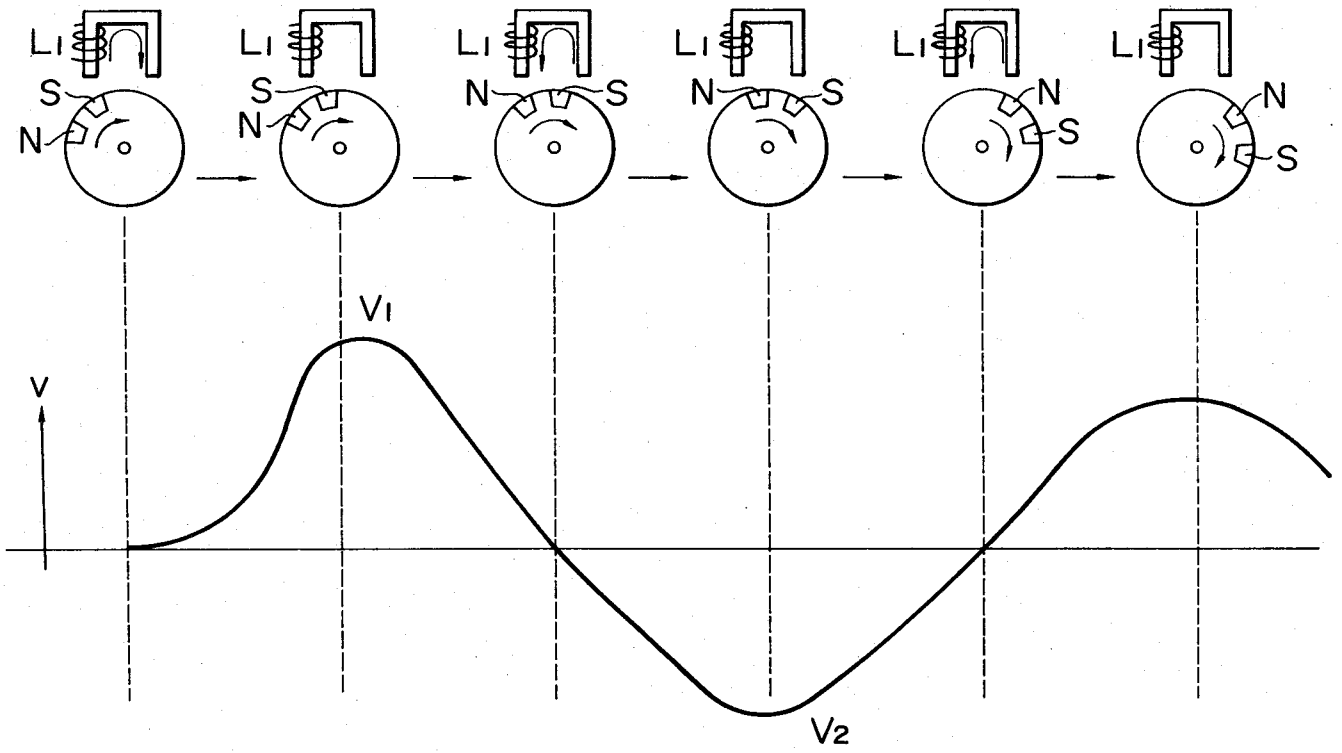
FIG. 3 is a diagram showing the relation between a series of operations performed in timed relation to each other by the ignition system shown in FIG. 1 and the wave form of the voltages shown in FIG. 2.

FIG. 3 shows the relation between the wave form of the voltages generated in the first generating coil $L_1$ and the relative positions of the coil $L_1$ and the negative pole S and positive pole N of the permanent magnet or the flywheel F. The relation between the wave form of the voltages generated in the second generating coil $L_4$ and the relative positions of the coil $L_4$ and the negative pole S and positive pole N of the permanent magnet is similar to the relation shown in FIG. 3. It will be seen, however, that the voltage generated by the second generating coil $L_4$ is smaller in absolute value than the voltage generated by the first generating coil $L_1$.

Thus, by selecting for the second generating coil $L_4$ a position which is suitably displaced angularly from the position of the first generating coil $L_1$, it is possible to obtain as desired a delay in the timing at which ignition is effected. It is also possible for the operator to selectively switch the engine between the two ignition timings in an instant by actuating the switch SW, regardless of the engine speed.

The ignition system according to the invention may have application in an internal combustion engine of a portable chain saw. In this application, the switch SW of the ignition system is linked to a throttle lever of the internal combustion engine. The switch SW is brought to an OFF position to advance the ignition timing when the throttle lever is operated in such a manner that a throttle valve of a carburettor is opened to accelerate the engine which is idling, and the switch SW is brought to an ON position to delay the ignition timing when the throttle lever is actuated in such a manner that the throttle valve is closed to decelerate the engine to idling or to stop the engine. By this arrangement, it is possible for the operator to automatically switch the engine between the two ignition timings merely by operating the throttle lever. This makes it possible to effect engine startup smoothly and to reduce noises produced by the engine by keeping the engine speed low and stable during idling. This also makes it possible to smoothly accelerate the engine at high engine output when the engine speed is high. Moreover, a delayed ignition timing at engine startup is conducive to reduced risks of quenching.

In another application, the switch SW may be linked to a safety lock, a throttle lock or a recoil starter used when the engine is started, so as to move the switch between the OFF and the ON positions.

What is claimed is:

1. An ignition system of an internal combustion engine comprising:

a permanent magnet supported by a rotary member of the engine adapted to rotate in synchronism with an rotary shaft of the engine;

a generating coil for generating an electromotive force to produce an electric current as the permanent magnet acts on the generating coil during the rotation of the rotary member;

an ignition capacitor charged by the electric current generated by the generating coil;

a thyristor caused to turn on by a counter electromotive force generated by the generating coil to thereby cause the ignition capacitor to begin to discharge; and an ignition coil generating a high voltage as the ignition capacitor begins to discharge, to cause a spark discharge to take place in an ignition plug of the internal combustion engine;

wherein the improvement comprises:

a bypass circuit having a switch capable of being closed to cause an electric current produced by the counter electromotive force to bypass the thyristor; and a second generating coil located anterior to the first-mentioned generating coil with respect to the direction of rotation of the rotary member for generating an electromotive force under the influences of the permanent magnet to cause the thyristor to turn on.

* * * * *